US011628462B2

(12) United States Patent
Berlovan, Jr. et al.

(10) Patent No.: US 11,628,462 B2
(45) **Date of Patent: *Apr. 18, 2023**

(54) HANDHELD SHOWER ASSEMBLY

(71) Applicant: HOMEWERKS WORLDWIDE, LLC, Lake Bluff, IL (US)

(72) Inventors: Viorel Berlovan, Jr., Medina, OH (US); Michael J. Cugini, North Royalton, OH (US); David M. Flowers, Rocky River, OH (US); John C. Holzheimer, Chagrin Falls, OH (US); Andrew B. Logar, Willowick, OH (US)

(73) Assignee: HOMEWERKS WORLDWIDE, LLC, Lake Bluff, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/860,987

(22) Filed: Jul. 8, 2022

(65) Prior Publication Data

US 2022/0339657 A1 Oct. 27, 2022

Related U.S. Application Data

(63) Continuation of application No. 16/414,174, filed on May 16, 2019, now Pat. No. 11,383,260.

(60) Provisional application No. 62/724,732, filed on Aug. 30, 2018, provisional application No. 62/672,099, filed on May 16, 2018.

(51) Int. Cl.
*B05B 1/18* (2006.01)
*B05B 15/62* (2018.01)

(52) U.S. Cl.
CPC ..... *B05B 15/62* (2018.02); *B05B 1/18* (2013.01)

(58) Field of Classification Search
CPC ..... B05B 1/18–185; E03C 1/06
See application file for complete search history.

(56) References Cited

U.S. PATENT DOCUMENTS

| | | | | |
|---|---|---|---|---|
| 3,471,872 | A * | 10/1969 | Symmons | E03C 1/0408 4/570 |
| 3,865,310 | A | 2/1975 | Elkins | |
| 3,971,074 | A | 7/1976 | Yxfeldt | |
| 3,979,096 | A | 9/1976 | Zieger | |
| 4,579,476 | A * | 4/1986 | Post | F16D 3/387 403/322.2 |
| 4,719,654 | A | 1/1988 | Blessing | |
| 5,749,552 | A | 5/1998 | Fan | |
| 5,911,444 | A * | 6/1999 | Buchter | B60T 17/043 285/83 |
| 6,446,278 | B1 | 9/2002 | Lin | |

(Continued)

FOREIGN PATENT DOCUMENTS

| | | |
|---|---|---|
| CN | 202290419 | 7/2012 |
| DE | 3002461 | 7/1981 |

(Continued)

*Primary Examiner* — Joseph A Greenlund
(74) *Attorney, Agent, or Firm* — Cozen O'Connor

(57) ABSTRACT

A water dispensing assembly including a handheld dispenser, a receiver mountable to an outlet pipe, a coupling mechanism for releasably coupling the handheld dispenser with the receiver. The coupling mechanism can include a male component adapted to be received in a female component, and a retention flange adapted to engage the receiver to assist in retaining the dispenser in a coupled state.

14 Claims, 16 Drawing Sheets

(56) References Cited

U.S. PATENT DOCUMENTS

| | | | | |
|---|---|---|---|---|
| 6,502,796 | B1 | 1/2003 | Wales | |
| 7,197,776 | B2 | 4/2007 | Tsai | |
| 7,299,510 | B2 | 11/2007 | Tsai | |
| 7,360,723 | B2 * | 4/2008 | Lev | E03C 1/0408 239/443 |
| 7,665,676 | B2 | 2/2010 | Lev | |
| 7,837,133 | B2 * | 11/2010 | Zhou | B05B 15/65 239/289 |
| 7,900,295 | B2 | 3/2011 | Lev | |
| 7,909,061 | B2 | 3/2011 | Nelson | |
| 7,937,784 | B2 | 5/2011 | Qiu | |
| 8,096,488 | B2 * | 1/2012 | Mueller | B05B 1/1663 239/289 |
| 8,191,185 | B2 | 6/2012 | Tsai | |
| 8,720,799 | B2 | 5/2014 | Tseng | |
| 8,919,379 | B2 * | 12/2014 | Zhou | E03C 1/0408 137/625.48 |
| 9,149,817 | B2 * | 10/2015 | Lev | E03C 1/0408 |
| 9,315,975 | B2 | 4/2016 | Davidson et al. | |
| 9,410,309 | B2 | 8/2016 | Sharratt et al. | |
| 9,438,977 | B2 * | 9/2016 | Wang | B05B 15/62 |
| 9,637,905 | B2 | 5/2017 | Hauth | |
| 10,150,121 | B2 * | 12/2018 | Lin | E03C 1/025 |
| 10,537,904 | B2 * | 1/2020 | Lin | B05B 15/65 |
| 10,618,065 | B2 * | 4/2020 | Lin | B05B 15/65 |
| 10,919,056 | B2 * | 2/2021 | Luo | B05B 1/1636 |
| 11,383,260 | B2 * | 7/2022 | Berlovan, Jr. | B05B 15/62 |
| 2003/0041372 | A1 | 3/2003 | Yang | |
| 2004/0034920 | A1 | 2/2004 | Antoniello et al. | |
| 2005/0098661 | A1 | 5/2005 | Lev | |
| 2006/0272086 | A1 | 12/2006 | Mesa | |
| 2007/0022528 | A1 * | 2/2007 | Gilbert | E03C 1/06 4/615 |
| 2007/0272770 | A1 | 11/2007 | Leber et al. | |
| 2008/0073446 | A1 * | 3/2008 | Zhou | B05B 1/185 239/289 |
| 2008/0121739 | A1 | 5/2008 | Lev | |
| 2009/0007330 | A1 * | 1/2009 | Genord | B05B 1/18 4/695 |
| 2009/0127349 | A1 * | 5/2009 | DeLeo | E04D 13/0762 239/208 |
| 2010/0024909 | A1 | 2/2010 | Lu et al. | |
| 2012/0325353 | A1 * | 12/2012 | Zhou | B05B 1/1618 137/625 |
| 2013/0032647 | A1 | 2/2013 | Zhou et al. | |
| 2013/0161420 | A1 | 6/2013 | Tseng | |
| 2013/0299608 | A1 * | 11/2013 | Spangler | B05B 1/18 239/525 |
| 2013/0320116 | A1 * | 12/2013 | Jonte | E03C 1/06 239/600 |
| 2015/0115064 | A1 | 4/2015 | Wu et al. | |
| 2016/0236118 | A1 * | 8/2016 | Sharratt | B05B 15/40 |
| 2016/0236223 | A1 * | 8/2016 | Scheffer | E03C 1/06 |
| 2017/0259279 | A1 * | 9/2017 | Lin | B05B 15/65 |
| 2017/0326561 | A1 * | 11/2017 | Sharratt | C02F 1/003 |
| 2018/0056308 | A1 | 3/2018 | Borges | |
| 2018/0193851 | A1 * | 7/2018 | L'Henaff | E03C 1/0409 |
| 2018/0195257 | A1 * | 7/2018 | Hu | B05B 1/1627 |
| 2018/0339300 | A1 * | 11/2018 | Lin | B05B 15/65 |
| 2020/0109542 | A1 * | 4/2020 | Mavinahally | E03C 1/0408 |

FOREIGN PATENT DOCUMENTS

| | | |
|---|---|---|
| DE | 102006056511 | 6/2008 |
| WO | WO 2000032317 | 6/2000 |
| WO | WO2012050894 | 4/2012 |

* cited by examiner

HANDHELD SHOWER ASSEMBLY

This application is a continuation of U.S. patent application Ser. No. 16/414,174 which was filed with the U.S. Patent and Trademark Office on May 16, 2019. This application claims priority to and the benefit of the filing date of U.S. Provisional Patent Application Ser. No. 62/724,732, filed Aug. 30, 2018, and U.S. Provisional Patent Application Ser. No. 62/672,099, filed May 16, 2018, which applications are hereby incorporated by reference.

FIELD OF THE INVENTION

The present exemplary embodiments relate to showerheads. It finds particular application in conjunction with a handheld shower and will be described with particular reference thereto. However, it is to be appreciated that the present exemplary embodiments are also amenable to other like applications.

DISCUSSION OF RELATED ART

Handheld showers and wands are popular for allowing a user more flexibility when showering. Typical handheld showers often include a bracket that is configured to support the handheld shower on or adjacent an outlet pipe when not being actively manipulated by a user. In one example, a handle of a handheld shower is configured to be received in a bracket that is mounted to the outlet pipe. A user can shower with the handheld shower supported in the bracket and serving as a conventional fixed showerhead or remove the handheld shower from the bracket for showering in a handheld mode.

Past handheld shower mounts have been difficult for users to operate, particularly when the user is in the midst of showering and wishes to switch between the fixed showerhead mode and the handheld shower mode. In many cases, proper alignment of the handheld shower with the bracket is not as easy as it could be. In other cases, a user may fail to properly or fully seat the handheld showerhead in the bracket resulting in the handheld showerhead drooping or coming free from the bracket.

SUMMARY OF THE INVENTION

The present disclosure sets forth a water dispensing assembly that is quickly and easily convertible between a fixed mount dispenser mode and a handheld dispenser mode and provides audible and/or tactile verification of engagement/coupling of the handheld dispenser with the receiver.

In accordance with one aspect, a water dispensing assembly comprises a handheld dispenser, a receiver mountable to an outlet pipe, a coupling mechanism for releasably coupling the handheld dispenser with the receiver. The coupling mechanism includes a male component adapted to be received in a female component, the male component being associated with the receiver and the female component being associated with the handheld dispenser.

The male component can extend from a front or first surface of the receiver opposite an inlet of the receiver. The female component can include a recess in a surface of the handheld dispenser opposite a surface of the handheld dispenser having an outlet for dispensing water. The female component can further include at least one pin supported for radial movement within the recess between a first radially inner position extending at least partially into the recess, and a second radially outer position. The male component can include a circumferential recess on a radially outer side thereof, the circumferential recess configured to receive the at least one pin when the male component is received in the female component thereby restricting separation of the handheld dispenser from the receiver. The at least one pin can be biased towards the first radially inner position. The at least one pin can include a shoulder for limiting further radially inward movement of the pin beyond the first radially inner position, the shoulder adapted to contact a surface of the receiver to produce audible feedback when the at least one pin is received in the circumferential recess of the male portion. A rear or second surface of the handheld dispenser can extend at a non-zero angle relative to a handle portion of the handheld dispenser. The male component can be tapered, and the female component can have a corresponding shape to closely receive the male component. The handheld dispenser can further include a retention flange adapted to engage a lip of receiver. The retention flange can be arcuate and spaced apart from the recess. The handheld dispenser can further include a protrusion extending from the handheld dispenser at a location between the retention flange and the recess, the protrusion cooperating with a receiver recess for centering the handheld dispenser relative to the receiver when the retention flange is engaged with the lip. The retention flange can include an axially extending wall and a radially inwardly extending wall, the radially inwardly extending wall adapted to restrict axial separation of the handheld dispenser from the receiver when engaged with the lip. The receiver can include a flow passageway for transmitting water from an inlet to an outlet, the receiver being mountable to an outlet pipe.

DETAILED DESCRIPTION

Figure 1:
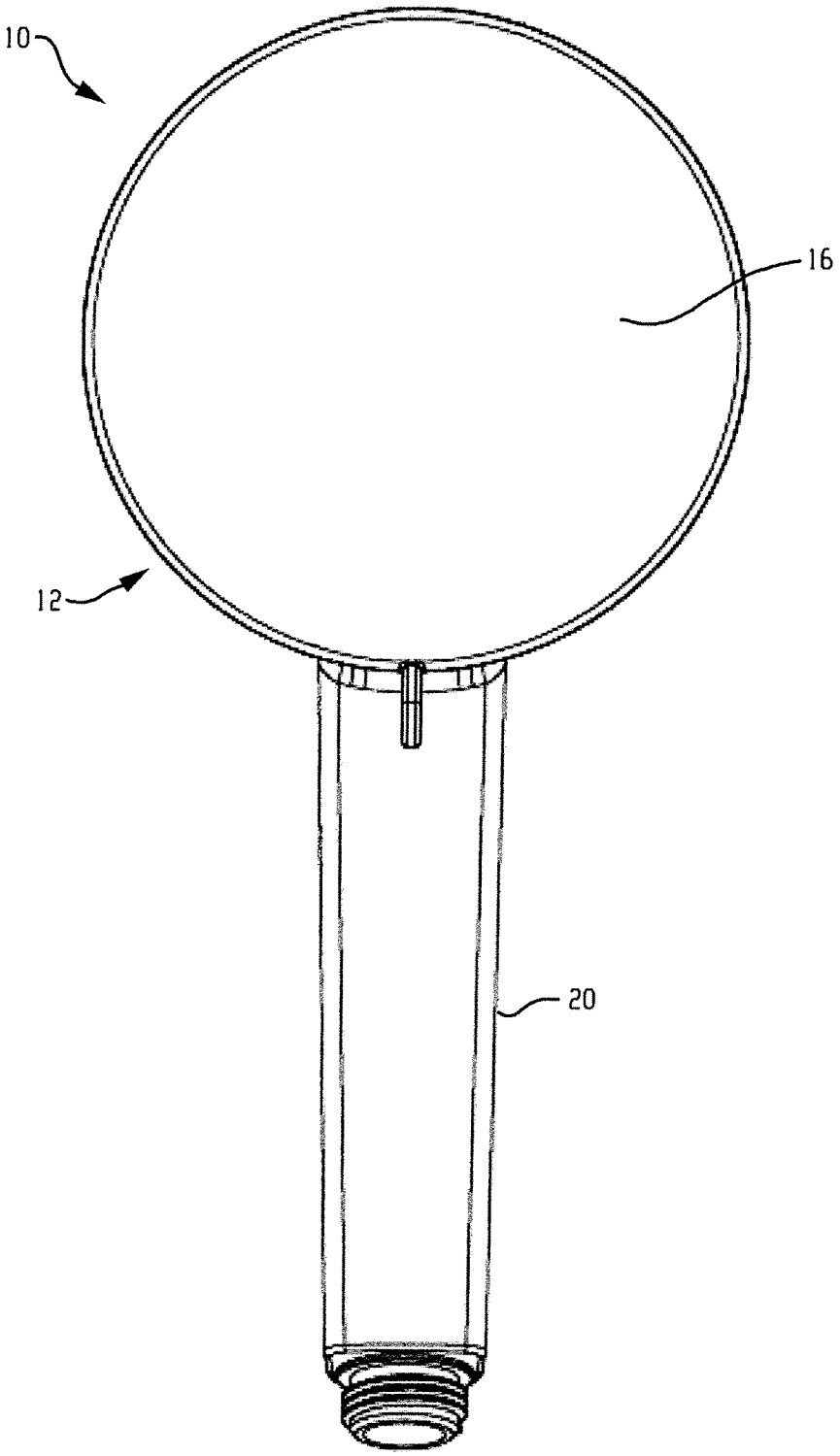
FIG. 1 is a front elevational view of an exemplary handheld shower assembly in accordance with the present disclosure.
Figure 2:
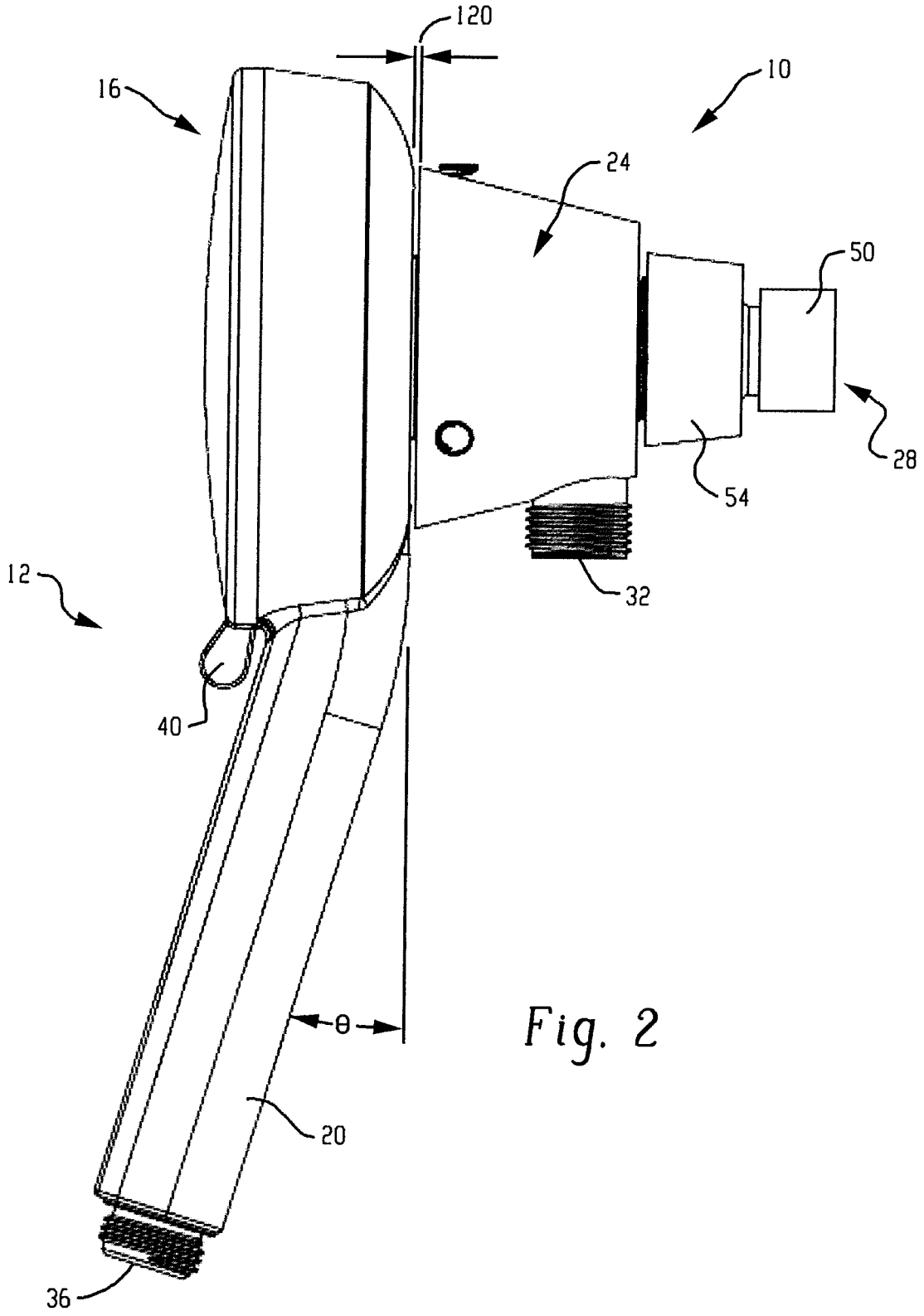
FIG. 2 is a side elevational view of the handheld shower assembly.
Figure 3:
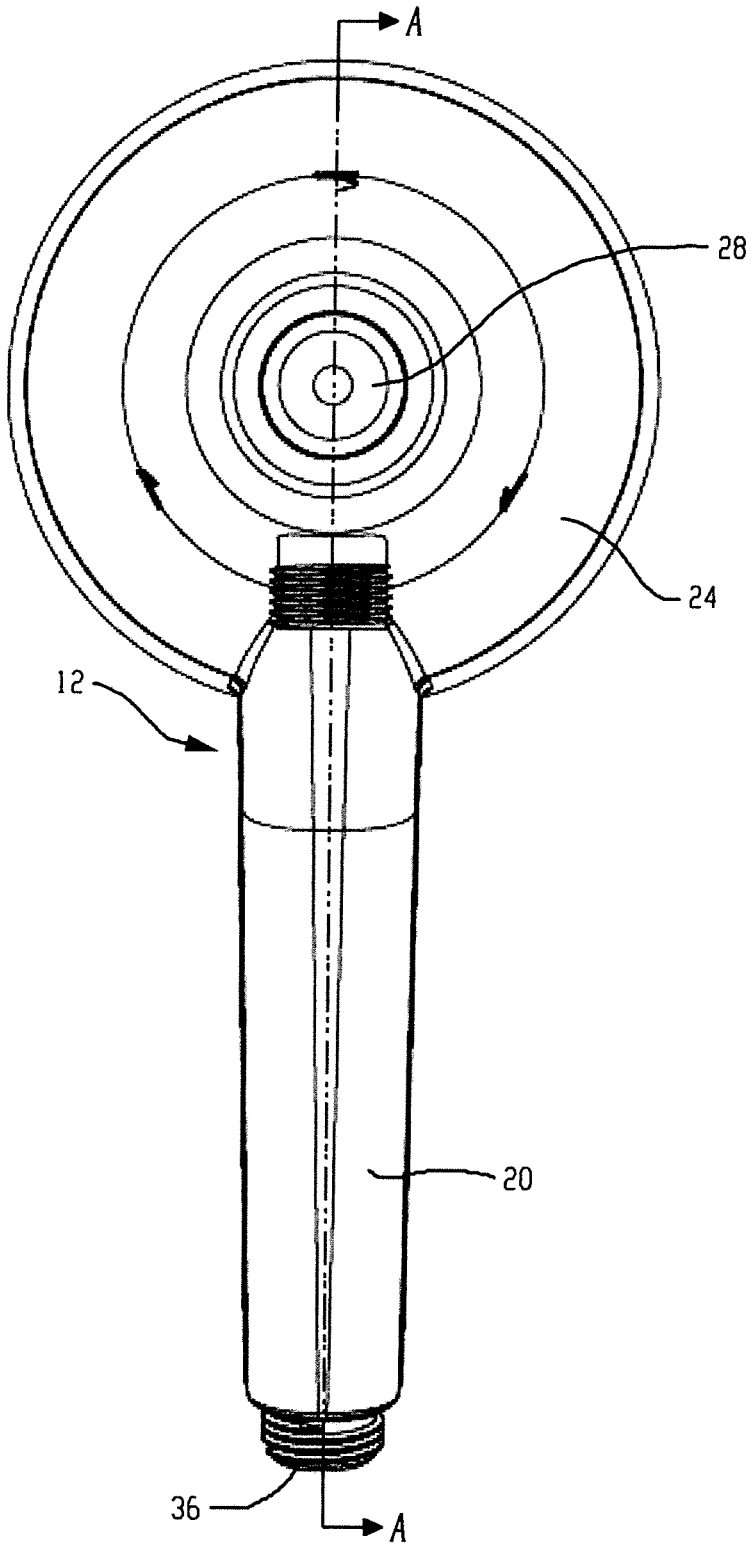
FIG. 3 is a rear elevational view of the handheld shower assembly.

Referring now to the drawings in detail, and initially to FIGS. 1-3, an exemplary handheld shower/wand assembly is illustrated and identified generally by reference numeral 10. The handheld shower assembly 10 includes a handheld showerhead 12 having a showerhead portion 16 and a handle portion 20. The handheld showerhead 12 is removably coupled with a receiver 24, which is configured to be mounted to a water outlet pipe (not shown) for a shower or the like for positioning the handheld showerhead 12 for directing water on a user.

The receiver 24 generally includes an inlet 28 adapted to be threadedly secured to the outlet pipe and an outlet 32 for supplying water from the outlet pipe to the handheld showerhead 12. Although not shown in the drawings, outlet 32 is typically attached to a supply hose that connects outlet 32 to an inlet 36 of the handheld showerhead 12. In this manner, the water supplied by the outlet pipe can flow through the receiver 24 to the handheld showerhead 12. The handheld showerhead 12 can have an adjustable showerhead that provides multiple different types of flow from the showerhead which may be selected by rotation of a selector 40 which functions to block or permit flow through one or more sets of nozzles (not shown) on the face of the showerhead portion 16.

Figure 4:
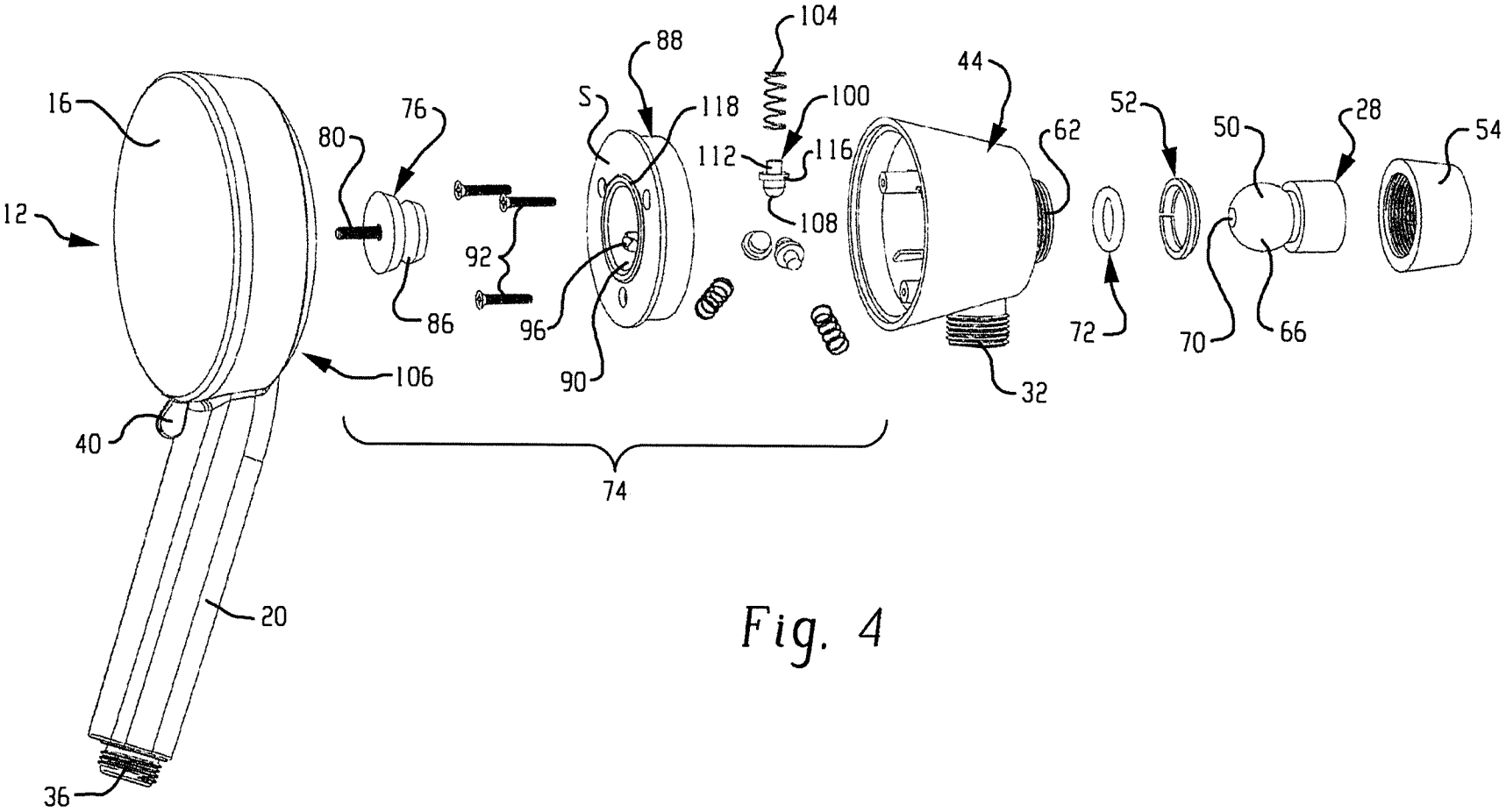
FIG. 4 is an exploded view of the handheld shower assembly.
Figure 5:
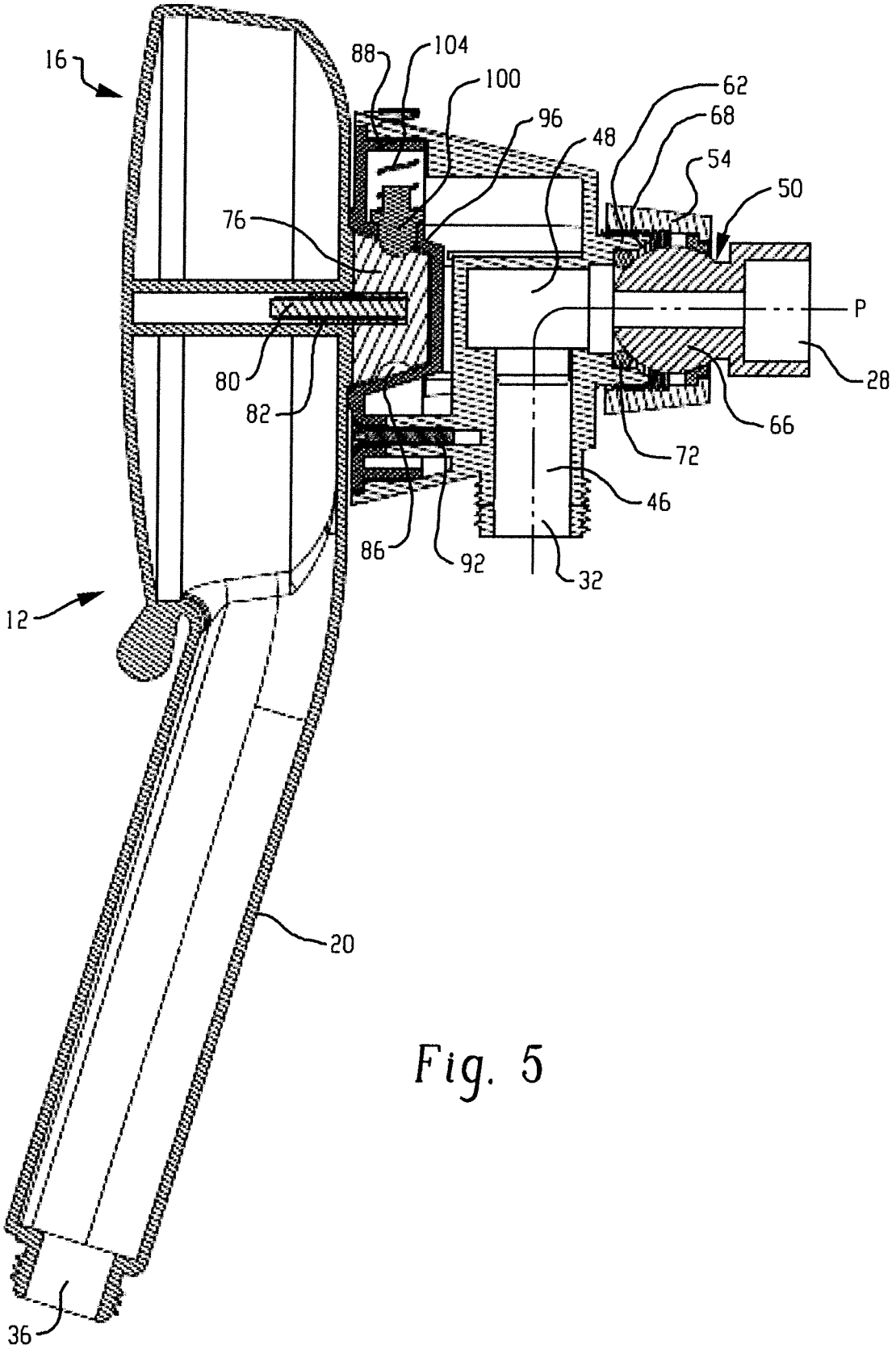
FIG. 5 is a cross-sectional view taken along the line A-A in FIG. 3.
Figure 6:
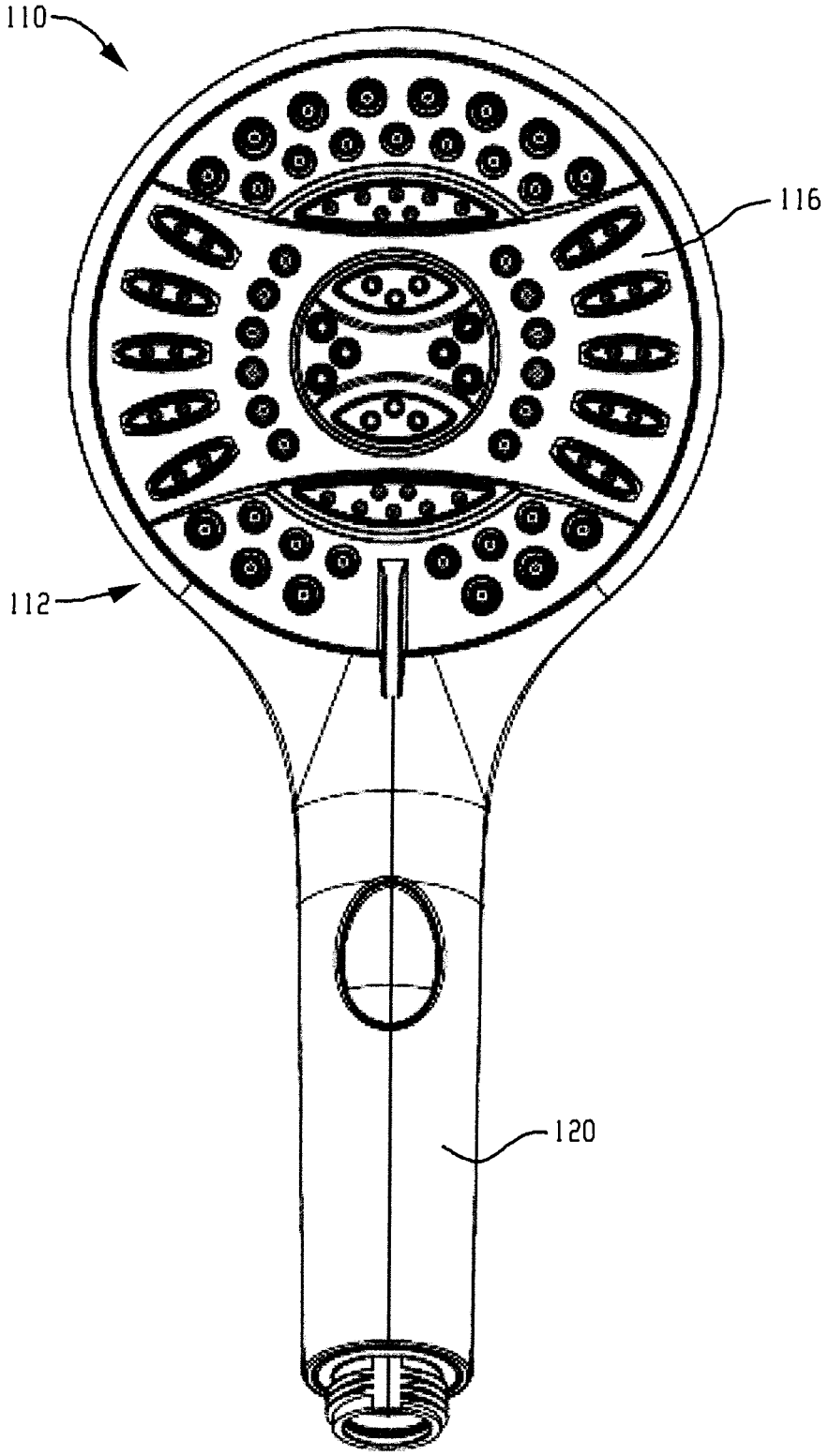
FIG. 6 is a front elevational view of another exemplary handheld shower assembly in accordance with the present disclosure.

Turning now to FIGS. 4 and 5, the internal details of the handheld showerhead 12 and the receiver 24 of the shower assembly 10 will be described. The receiver 24 includes a receiver body 44 having a flow passageway indicated by the line labelled P that extends internally between the inlet 28 and the outlet 32. The flow passageway P is formed by intersecting bores 46/48 within the receiver body 44, which in this embodiment extend at right angles to each other. In addition, a swivel nut 50 is coupled to the receiver body 44 by a retaining ring 52 and a retaining nut 54 that is threadedly engaged with a threaded nipple 62 of the receiver body 44. The swivel nut 50 has a ball portion 66 that is received in a socket 68 of the receiver body 44 for 360.degree. swiveling motion. The swivel nut 50 further has an interior passageway 70 for communicating with the intersecting bores 46/48 of the receiver body 44 to thereby form the passageway P from the inlet 28 to the outlet 32 of the receiver 24. An o-ring 72 or other sealing member is provided for sealing the swivel nut 50 to the receiver body 44. In some embodiments, the receiver 24 can be integrated in a diverter or other valve assembly configured to divert water between one or more showerheads. In other embodiments, the receiver 24 can be a separate unit mountable to any desired surface (e.g., a shower wall, a shower door, etc.), and may or may not include flow passageways for supplying water to the handheld shower.

The handheld showerhead 12 is releasably coupled to the receiver 24 by a coupling mechanism 74 that generally includes a male portion (associated with the handheld showerhead 12) that is received in a female portion (associated with the receiver 24). To this end, the handheld showerhead 12 includes a protrusion in the form of a knob 76 that is mounted or otherwise extends from a rear surface of the handheld showerhead 12. In the illustrated embodiment, the knob 76 includes a threaded shaft 80 that is received in a threaded bore 82 of the handheld showerhead 12. In other embodiments, the knob 76 can be formed integrally with the handheld showerhead 12, or it can be a separate component secured thereto by other securement such as adhesives, for example. The knob 76 includes an annular recess 86 that extends circumferentially about an outer diameter of the knob 76. In some embodiments, the annular recess may not be continuous, or may comprise one or more circumferentially spaced apart depressions in the outer circumferential surface of the knob 76. In such embodiments, the handheld showerhead 12 may only positively couple with the receiver 24 in one or more discrete orientations. In the illustrated embodiment, the knob 76 is tapered along its axial length from a larger diameter adjacent the threaded shaft 80 to a smaller diameter at a distal end thereof opposite the threaded shaft 80.

The receiver 24 includes a face plate 88 having a recess 90 configured to receive the knob 76. The face plate 88 is secured to the receiver body 44 by three screws 92. Within the recess 90 are three radially extending bores 96 that are spaced circumferentially about the recess at 120.degree. intervals. Supported for reciprocating radial movement within each radial bore 96 is a click pin 100. Each click pin 100 is biased radially inwardly by a compression spring 104 or other biasing element. The click pins 100 are movable between a radially inner position for engaging within the annual recess 86 of the knob 76 when the handheld showerhead 12 is coupled with the receiver 24, and a radially outer position permitting insertion or withdrawal of the knob 76 from the recess 90. Each click pin 100 has a rounded head 108 and a spring retainer post 112. A radially outwardly extending shoulder 116 of each click pin 100 is configured to engage with a surface of the receiver body 44 when the click pin 100 is in the radially inner position.

In use, a user can grasp the handle 20 of the handheld showerhead 12 and pull the handheld showerhead 12 away from the receiver 24 during which motion the knob 76 urges the click pins 100 radially outward thereby allowing the knob 76 to be released from the recess 90 of the receiver 24. The radial extent of the face plate 88 provides a surface S against which a rear surface 106 the handheld showerhead 12 can by pivoted to generate a leveraging action that tends to separate the handheld showerhead 12 from the receiver 24. For example, a user may more easily separate the handheld showerhead 12 from the receiver 24 by rotating the handle portion 20 clockwise from the position of FIG. 2. As the handle portion is rotated in such direction, the top side of the rear surface 106 of the handheld showerhead 12 can pivot against surface S allowing one or more of the lower click pins 100 to release, followed by the remaining click pins 100.

To replace the showerhead 12, the user aligns the knob 76 with the recess 90 in the receiver 24 and applies a force in a direction to insert the knob 76 into the recess 90 at which time the leading surfaces of the knob 76 urge the lock pins 100 radially outwardly until the annular recess 86 in the knob 76 is substantially axially aligned with the reciprocating axis of the click pins 100 such that the compression springs 104 snap the click pins 100 radially inwardly into the annular recess 86 thereby releasably coupling the handheld showerhead 12 to the receiver 24.

In contrast to many prior art assemblies which require movement of the handheld showerhead laterally for coupling (e.g., traverse to the central spray axis of the showerhead portion), the recess 90 of the receiver 24 of the present disclosure generally has a central axis that is aligned with respect to a central axis of the showerhead portion 16 when the components are coupled together. Because of this, positioning of and coupling of the handheld showerhead 12 is intuitive because a user can simply position the handheld showerhead 12 in the "fixed" mode position and move the handheld showerhead 12 along the central axis to couple the handheld showerhead 12 with the receiver. That is, the coupling action is along an axis and in a position well-known to the user. This feature, combined with the audible feedback of the click pins 100, allows many users to easily couple and decouple the handheld showerhead 12 from the receiver 24 without looking at either component.

It should be appreciated that when the axial alignment of the knob 76 with the click pins 104 reaches a certain position (which may not be completely in axial alignment), the compression springs 104 force the click pins 100 rapidly radially inwardly resulting in an audible click sound when the shoulder 116 of each click pin 100 engages the corresponding surface of the receiver body 44. This audible click provides audible feedback to a user such that confirmation of coupling of the handheld showerhead 12 with the receiver 24 can be made by the user without visual inspection. This feature allows a user who is not looking, or is not capable of looking (e.g., soap in eyes, etc.) to reliably confirm coupling between the handheld showerhead 12 and receiver 24.

It should be appreciated that the coupling mechanism 74 of the present disclosure facilitates coupling of the handheld showerhead 12 and the receiver 24 in a wide range of relative angles. In the illustrated embodiment, the handheld showerhead 12 can be coupled to the receiver 24 in any relative angular orientation (e.g., full 360 degree coupling capability). Thus, a user does not need to align (e.g., "clock") the handheld showerhead 12 in a particular orientation in order to effect coupling/decoupling with the receiver 24. Further, once coupled, relative rotation between the handheld showerhead 12 and the receiver 24 is possible. This makes positioning of the handle portion 20 and/or hose (not shown) in any desired position possible. This feature can be useful when adjacent structure would otherwise interfere with positioning (e.g., when a showerhead mounted rack is used).

As shown in FIG. 2, the handle portion 20 of the handheld showerhead 12 is angled relative to the rear surface 106 of the handheld showerhead 12. The angle theta is approximately a non-zero angle. In some embodiments, the non-zero angle can be between 10 and 40 degrees. It should be appreciated that the receiver 24 will typically be angled downwardly when installed on a shower outlet pipe such that when the handheld showerhead 12 is coupled therewith, the angle theta generally results in the handle portion 20 extending vertically. The angle theta further positions the handle portion 20 in spaced relation to adjacent structure to provide clearance for grasping by a user.

It should be appreciated that at least a major portion of the rear surface 106 of the showerhead portion 16 is spaced from the face plate 88 when the handheld showerhead 12 is coupled to the receiver 24. An axially protruding lip 118 surrounds the recess 90 and thereby creates an air space 120 therebetween. The air space 120 can prevent mold and mildew growth between the components. The lip 118 can be made of a resilient material in some embodiments to provide a smoother action to the coupling mechanism 74.

Turning now to FIGS. 5-10, another exemplary handheld shower/wand assembly is illustrated and identified generally by reference numeral 110. The handheld shower assembly 110 includes a handheld showerhead 112 having a showerhead portion 116 and a handle portion 120. The handheld showerhead 112 is removably coupled with a receiver 124, which is configured to be mounted to a water outlet pipe of a shower or the like for positioning the handheld showerhead 112 for directing water on a user.

The handheld showerhead 112 is releasably coupled to the receiver 124 by a coupling mechanism 174 (see FIG. 10) that generally includes a male portion (associated with the receiver 124) that is received in a female portion (associated with the handheld showerhead 112). As will be appreciated, the location of the male and female portions of the coupling mechanism 174 are switched as compared to the embodiment of FIGS. 1-5. Aside from this, the coupling mechanism 174 is similar to the coupling mechanism 74 of FIGS. 1-5, and functions in a similar manner.

The receiver 124 includes a receiver body 144 having a flow passageway indicated by the line labelled P' that extends internally between an inlet 128 and an outlet 32. The flow passageway P' is formed by intersecting bores 46/48 within the receiver body 44, which in this embodiment extend at right angles to each other. In addition, a swivel nut 150 is coupled to the receiver body 144 by a retaining ring 152 and a retaining nut 154 that is threadedly engaged with a threaded nipple 162 of the receiver body 144. The swivel nut 150 has a ball portion 166 that is received in a socket 168 of the receiver body 144 for 360.degree. swiveling motion. The swivel nut 150 further has an interior passageway 170 for communicating with the intersecting bores 146/148 of the receiver body 144 to thereby form the passageway P' from the inlet 128 to the outlet 132 of the receiver 124. An o-ring 172 or other sealing member is provided for sealing the swivel nut 150 to the receiver body 144. As will be appreciated, a flexible conduit, such as a hose can be connected between the outlet of the receiver 132 and an inlet 136 of the handheld showerhead 112 for supplying water thereto.

In some embodiments, the receiver 124 can be integrated in a diverter or other valve assembly configured to divert water between one or more showerheads. In other embodiments, the receiver 124 may be a separate unit mountable to any desired surface (e.g., a shower wall, a shower door, etc.), and may or may not include flow passageways for supplying water to the handheld showerhead 112.

The receiver 124 includes a protrusion in the form of a knob 176 that is mounted or otherwise extends from a surface of the receiver 124. In the illustrated embodiment, the knob 176 is formed integrally with a body of the receiver 124. The knob 176 includes an annular recess 186 that extends circumferentially about an outer diameter of the knob 176. In some embodiments, the annular recess may not be continuous, or may comprise one or more circumferentially spaced apart depressions in the outer circumferential surface of the knob 176. In such embodiments, the handheld showerhead 112 may only positively couple with the receiver 124 in one or more orientations. In the illustrated embodiment, the knob 176 is tapered along its axial length from a larger diameter proximal end to a smaller diameter distal end thereof.

The handheld showerhead 112 includes a recess housing or rear plate 188 having a recess 190 configured to receive the knob 176. The recess housing 188 is secured to the handheld showerhead 112 via suitable fasteners, adhesives, or other suitable securing mechanisms. In some embodiments, the rear plate 188 can be integrally formed with a housing of the handheld showerhead 112. Within the recess 190 are three radially extending bores 196 that are spaced circumferentially about the recess at 120.degree. intervals.

Supported for reciprocating radial movement within each radial bore 196 is a click pin 200. Each click pin 200 is biased radially inwardly by a compression spring 204 or other biasing element. The click pins 200 are movable between a radially inner position for engaging within the annual recess 186 of the knob 176 when the handheld showerhead 112 is coupled with the receiver 124, and a radially outer position permitting insertion or withdrawal of the knob 176 from the recess 190. Each click pin 200 has a rounded head 208 and a spring retainer post 212. A radially outwardly extending shoulder 216 of each click pin 200 is configured to engage with a surface of the receiver body 144 when the click pin 200 is in the radially inner position.

The use and advantages of the handheld shower assembly 110 of FIGS. 5-10 are similar to the use and advantages of the handheld shower assembly of FIGS. 1-5. For example, a user can grasp the handle 120 of the handheld showerhead 112 and pull the handheld showerhead 112 away from the receiver 124 during which motion the knob 176 urges the click pins 200 radially outward thereby allowing the knob 176 to be released from the recess 190. To replace the showerhead 112, the user aligns the knob 176 with the recess 190 in the rear plate 188 and applies a force to the handheld showerhead 112 in a direction to insert the knob 176 into the recess 190 at which time the leading tapered surface of the knob 176 urges the lock pins 200 radially outwardly until the annular recess 186 in the knob 176 is substantially axially aligned with the reciprocating axis of the click pins 200 such that the compression springs 204 snap the click pins 200 radially inwardly into the annular recess 186 thereby releasably coupling the handheld showerhead 112 to the receiver 124. The coupling action is along an axis and in a position well-known to the user (e.g., a standard fixed showerhead position and orientation). This feature, combined with the audible feedback of the click pins 200, allows many users to easily couple and decouple the handheld showerhead 112 from the receiver 124 without looking at either component.

It should be appreciated that when the axial alignment of the knob 76 with the click pins 200 reaches a certain position (which may not be completely in axial alignment), the compression springs 204 force the click pins 200 rapidly radially inwardly resulting in an audible click sound when the shoulder 216 of each click pin engages the corresponding surface of the rear plate 188. This audible click provides audible feedback to a user such that confirmation of coupling of the handheld showerhead 112 with the receiver 124 can be made by the user without visual inspection. This feature allows a user who is not looking, or is not capable of looking (e.g., soap in eyes, etc.) to reliably confirm coupling between the handheld showerhead 112 and receiver 124.

It should also be appreciated that the coupling mechanism 174 of the present disclosure facilitates coupling of the handheld showerhead 12 and the receiver in a wide range of relative angles. In the illustrated embodiment, the handheld showerhead 112 can be coupled to the receiver 124 in any rotational position (e.g., full 360 degree coupling capability). Thus, a user does not need to align (e.g., "clock") the handheld showerhead 112 in a particular orientation in order to effect coupling/decoupling with the receiver 124. Further, once coupled, relative rotation between the handheld showerhead 112 and the receiver 124 is possible. Friction between the click pins 200 and the annular recess 186 resulting from the force applied to the click pins 200 by the springs 204 resists rotation of the showerhead 112 relative to the receiver 124 when coupled. Such friction is sufficient to maintain an orientation of the showerhead 112 relative to the receiver 124 but does not generally prohibit a user from changing the orientation of the showerhead 112 relative to the receiver 124 when desired. This makes positioning of the handle portion 120 and/or hose (not shown) in any desired position possible. This feature can be useful when adjacent structure would otherwise interfere with positioning (e.g., when a showerhead mounted rack is used).

Figure 7:
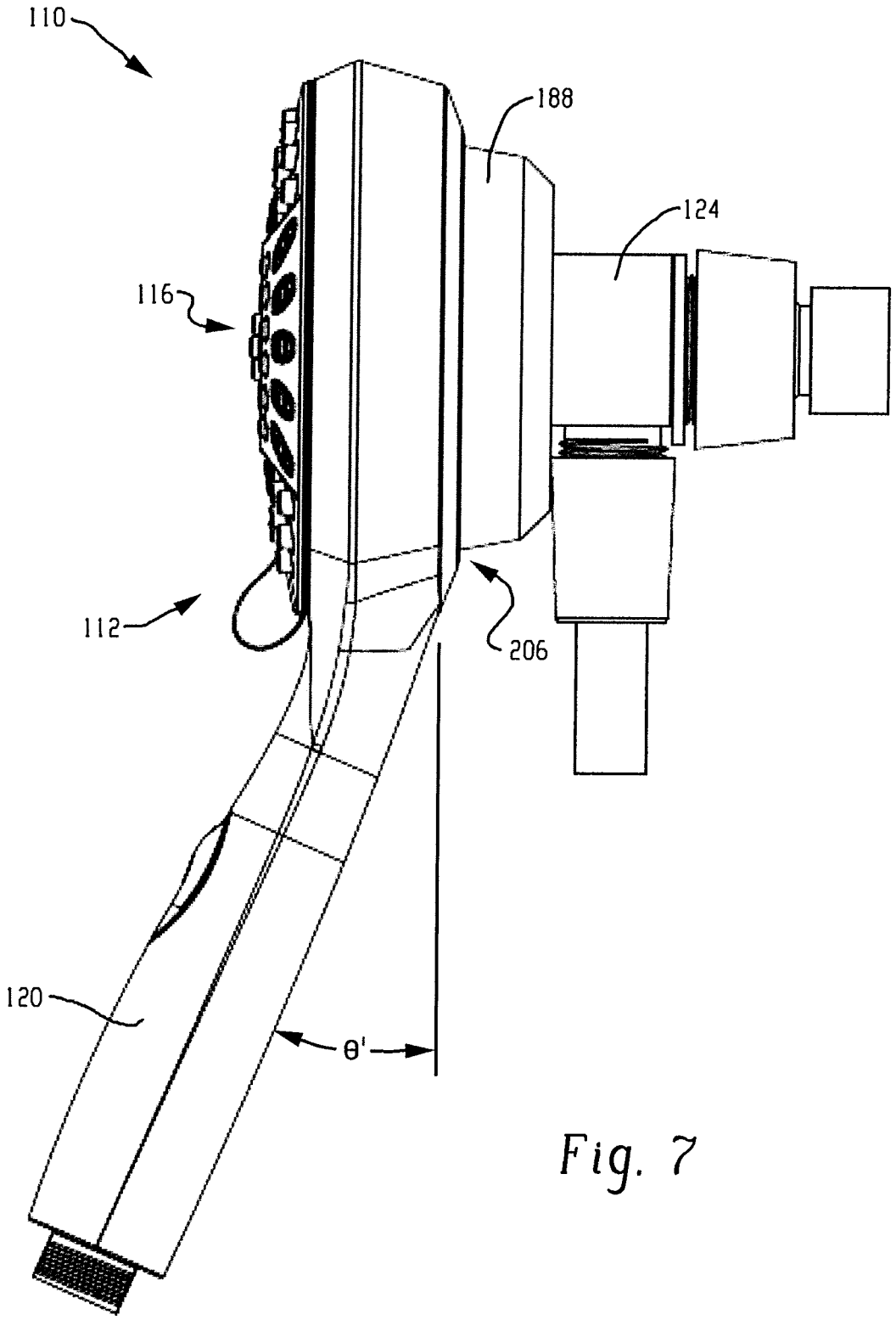
FIG. 7 is a side elevational view of the handheld shower assembly of FIG. 6.
Figure 8:
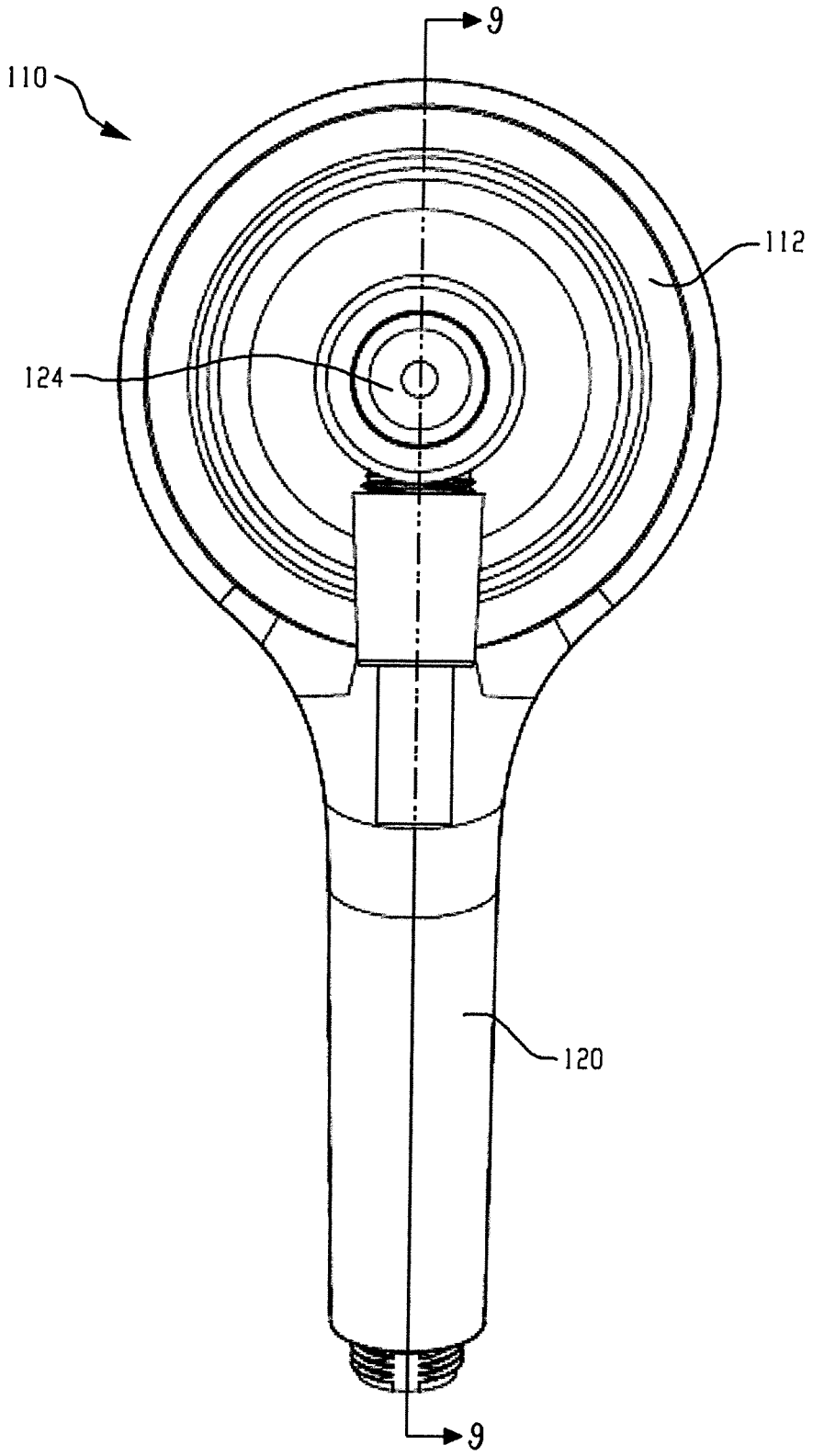
FIG. 8 is a rear elevational view of the handheld shower assembly of FIG. 6.
Figure 9:
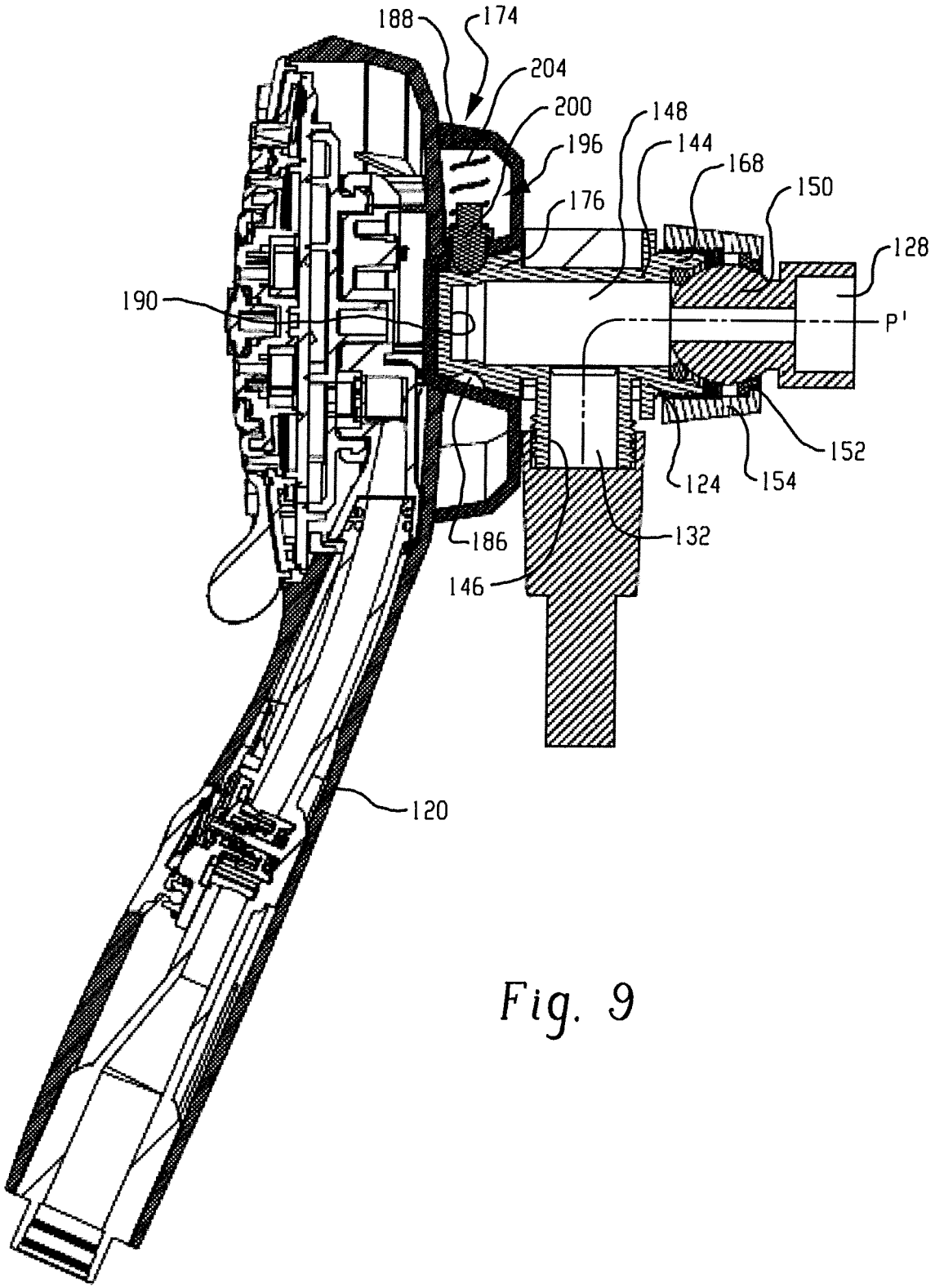
FIG. 9 is a cross-sectional view taken along the line 9-9 in FIG. 8.
Figure 10:
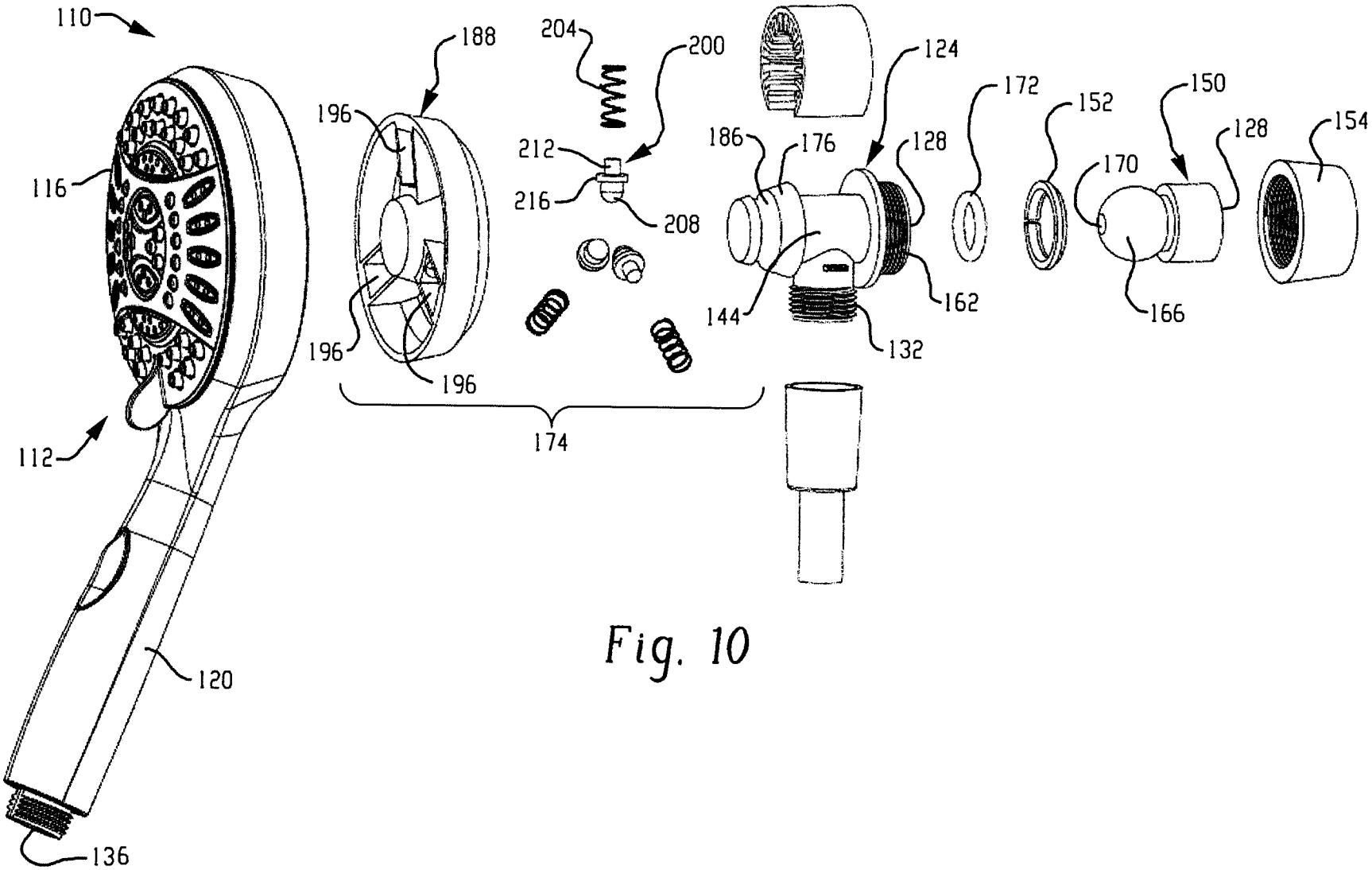
FIG. 10 is an exploded view of the handheld shower assembly of FIG. 6.
Figure 11:
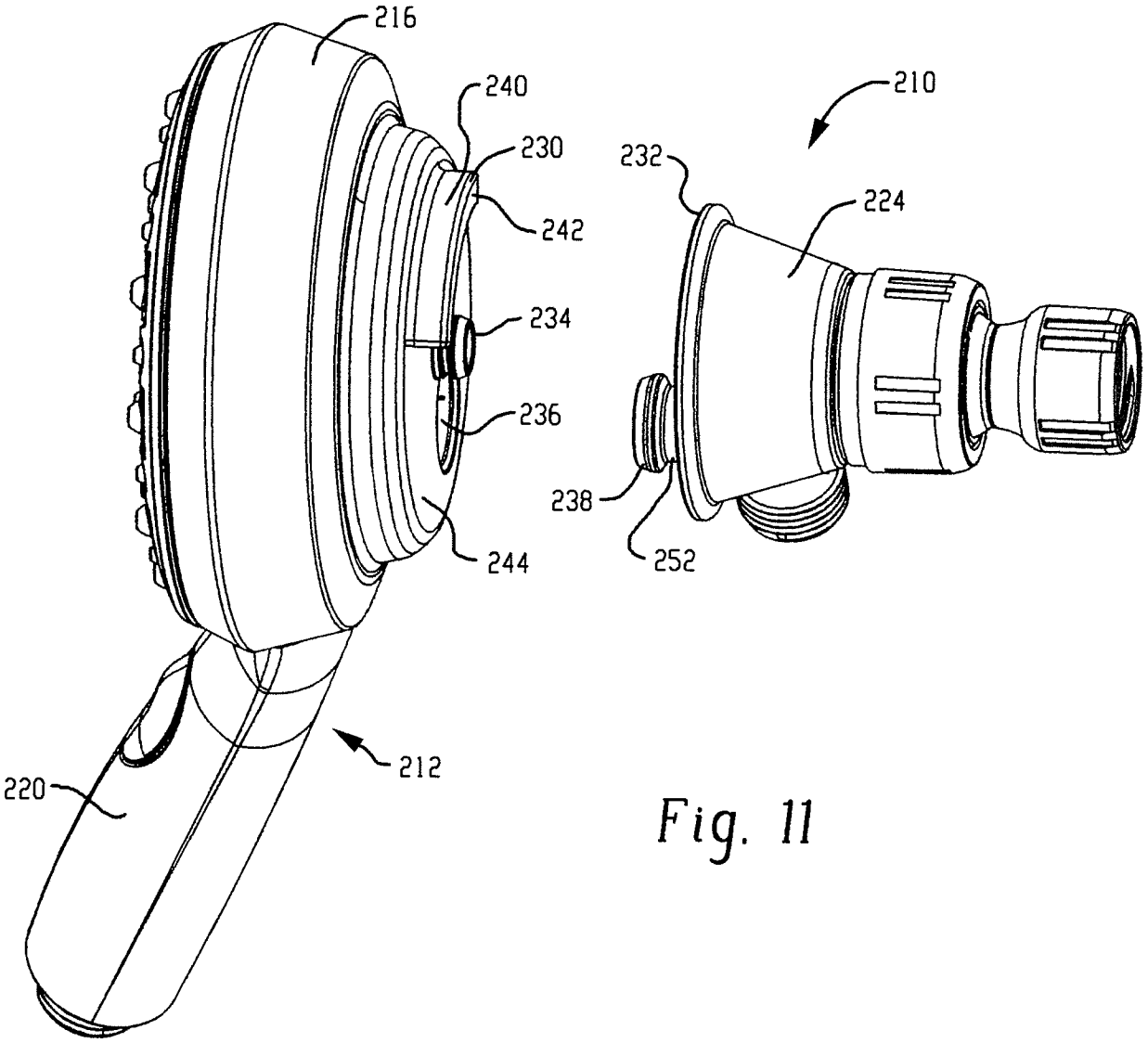
FIG. 11 is a perspective view of another exemplary handheld shower assembly in a detached state in accordance with the present disclosure.
Figure 12:
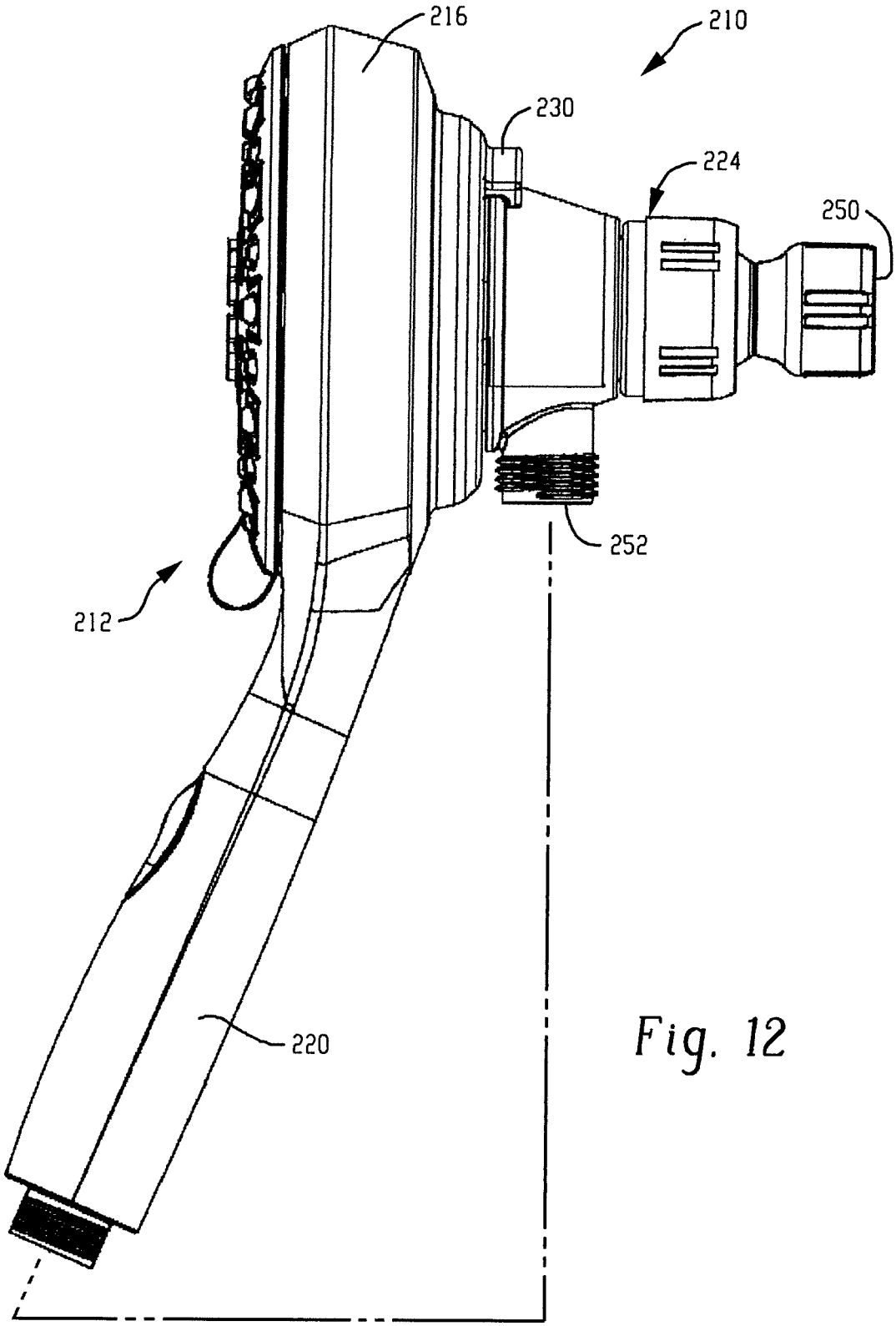
FIG. 12 is a side elevational view of the showerhead assembly of FIG. 11 in a coupled state.
Figure 13:
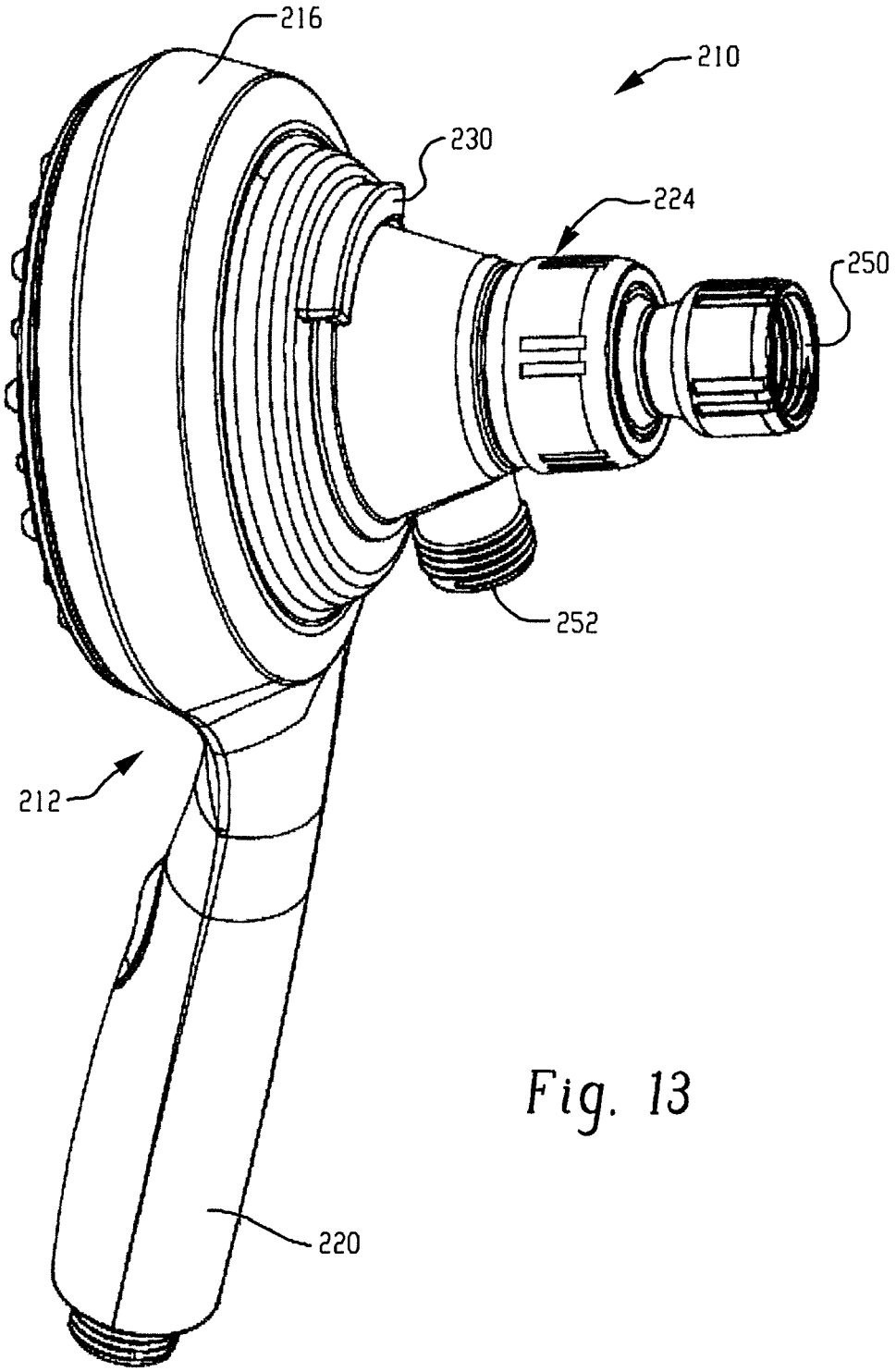
FIG. 13 is a perspective view of the showerhead assembly of FIG. 11 in a coupled state.
Figure 14:
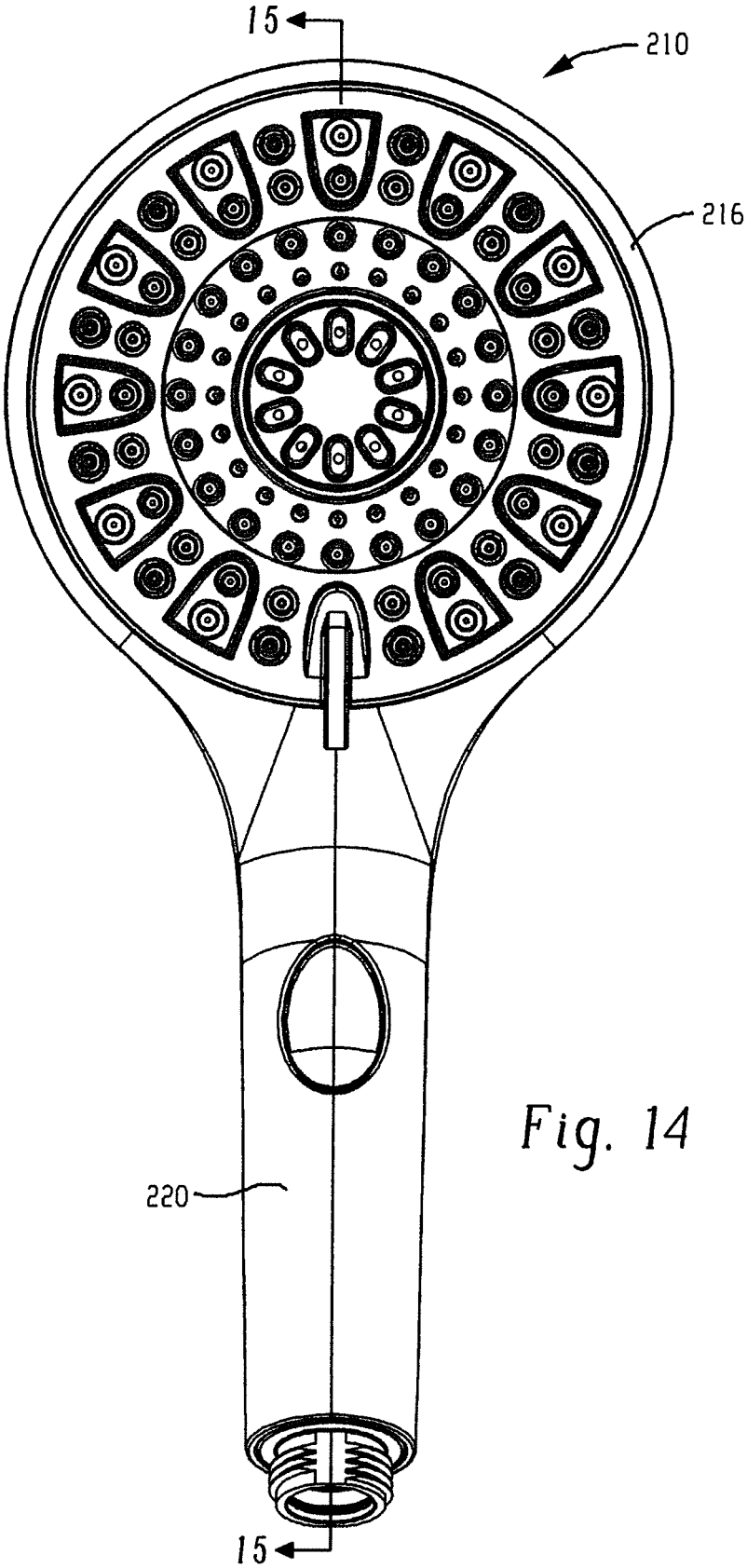
FIG. 14 is a front elevational view of the showerhead assembly of FIG. 11.

As shown in FIG. 7, the handle portion 120 of the handheld showerhead 112 is angled relative to the rear surface 206 of the handheld showerhead 12. The angle theta' is approximately a non-zero angle. In some embodiments, the non-zero angle can be between 10 and 40 degrees. It should be appreciated that the receiver 124 will typically be angled downwardly when installed on a shower outlet pipe such that when the handheld showerhead 112 is coupled therewith, the angle theta generally results in the handle portion 120 extending vertically. The angle theta further positions the handle portion 120 in spaced relation to adjacent structure to provide clearance for grasping by a user.

Turning now to FIGS. 11-15, another exemplary handheld shower/wand assembly is illustrated and identified generally by reference numeral 210. The handheld shower assembly 210 includes a handheld showerhead 212 having a showerhead portion 216 and a handle portion 220. The handheld showerhead 212 is removably coupled with a receiver 224, which is configured to be mounted to a water outlet pipe for a shower or the like for positioning the handheld showerhead 212 for directing water on a user. The receiver 224 is similar in many respects to the receiver 24/124 and therefore only the differences therebetween will be described herein.

The handheld showerhead 212 is releasably couplable to the receiver 224 by a coupling mechanism that generally includes an arcuate retention flange 230 on the showerhead portion 216 that is adapted to engage a lip 232 of the receiver 224, a centering protrusion 234 of the showerhead portion 216 that is adapted to be received in a corresponding recess of the receiver 224, and a recess 236 of the showerhead portion 216 adapted to receive a protrusion 238 of the receiver 224. The retention flange 230 includes an axially extending wall 240 and a radially inwardly extending wall 242. Together with the rear face 244 of the showerhead portion 216, the retention flange defines a slot for receiving the lip 232.

Together, the components of the coupling mechanism of this embodiment provide a positive engagement of the handheld showerhead 212 to the receiver 224 and facilitate a more intuitive user experience. The user experience is enhanced at least in part by the retention flange 230 which allows a user to first couple the retention flange 230 of the showerhead portion 216 with the lip 232 of the receiver 224 at virtually any relative angular orientation. In this initial position (e.g., first position with retention flange 230 engaged), the rear face 244 of the handheld showerhead 212 may be fully or partially spaced from the receiver 224 (e.g., handheld showerhead 212 angled relative to receiver 224). The handheld showerhead 212 can then be rotated clockwise or counterclockwise to change its angular orientation relative to the receiver 224 to align the recess 236 with the protrusion 238. To this end, the centering protrusion 234, which may be partially engaged with a recess 246 (see FIG. 15) of the receiver 224 in the initial position of the handheld showerhead 212, acts as a pivot point for the showerhead portion 216 and helps keep the retention flange 230 engaged with the lip 232. Once the recess 236 and protrusion 238 are aligned, the handheld showerhead 212 can be rocked into the final position (see FIGS. 12 and 13, for example) at which it is coupled with the receiver 224.

The retention flange 230 can act as a fulcrum pivoting against the lip 232 as the handheld showerhead 212 is pivoted to the final position. This increases the leverage a user has when coupling the handheld showerhead 212 to the receiver 224 and makes seating the protrusion 238 in the recess 236 easier. Conversely, for a given user applied force, the latching/coupling retention force of the coupling mechanism can be increased as compared to embodiments that do not utilize the lever action described above.

Figure 15:
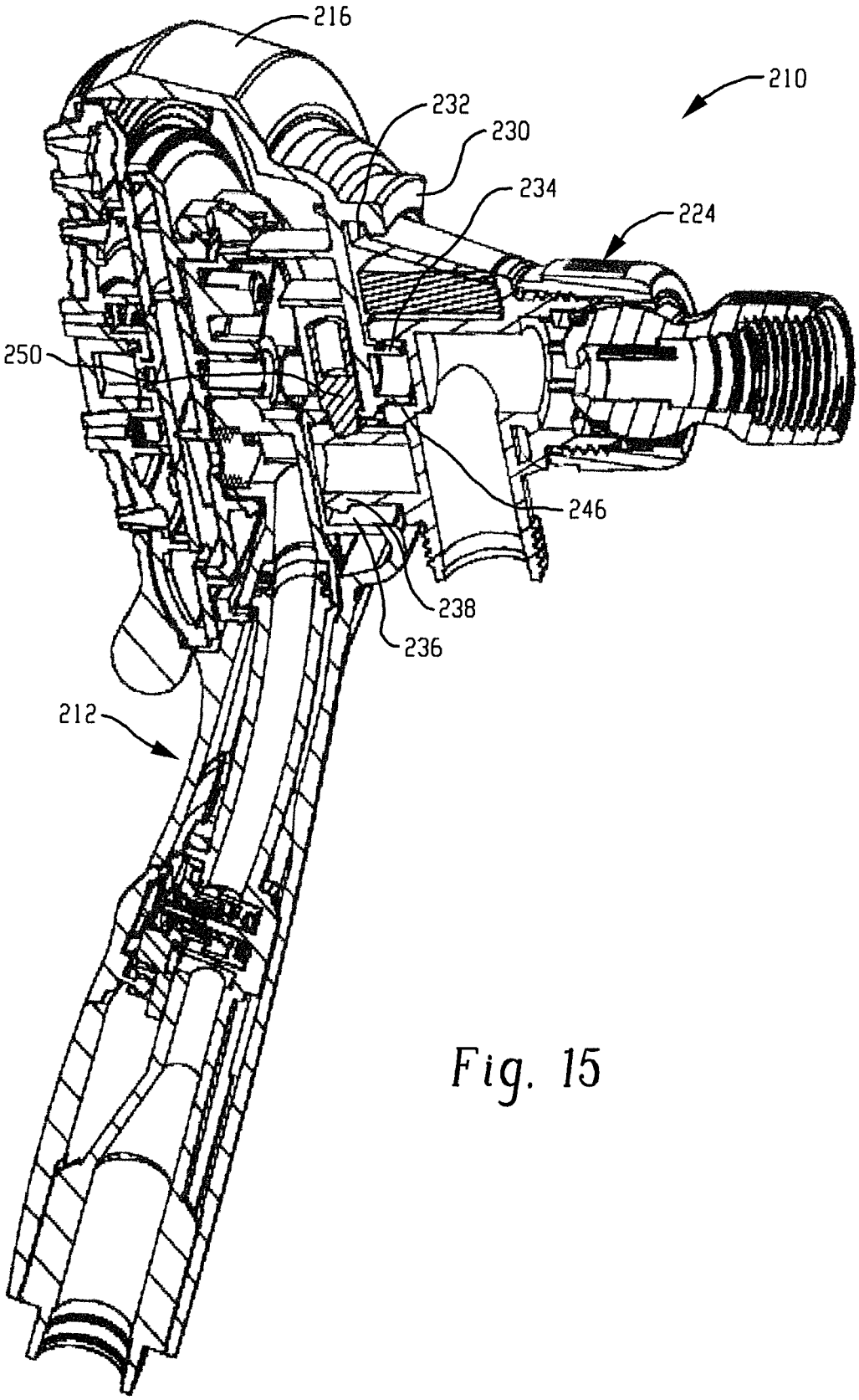
FIG. 15 is a cross-sectional view taken along the line 15-15 in FIG. 14.

As best seen in FIG. 15, it should be appreciated that the recess 236 of the showerhead portion 216 includes click pins 250 adapted to engage the protrusion 238 when in the final position. The click pins 250 are generally the same as the click pins and related structures shown and described in the embodiment of FIGS. 5-10. Accordingly, the click pins 250 are supported for reciprocating radial movement between a radially inner position for engaging within an annular recess 252 of the protrusion 238 when the handheld showerhead 212 is coupled with the receiver 224, and a radially outer position permitting insertion or withdrawal of the protrusion 238 from the recess 236. The click pins 250 help to retain the handheld showerhead 212 in a coupled state with the receiver 224 and can provide audible feedback to a user of positive engagement of the handheld showerhead 212 with the receiver 224.

Figure 16:
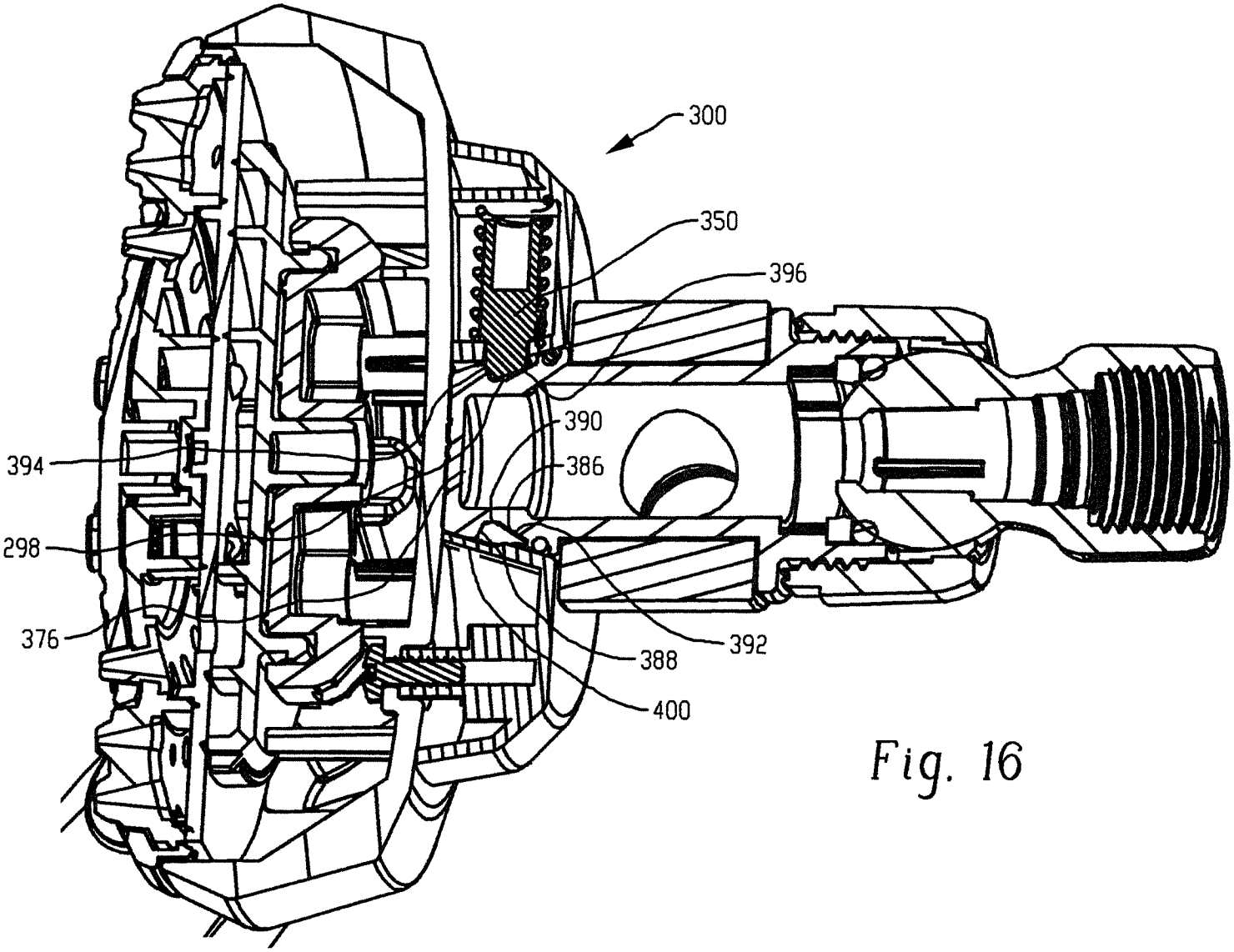
FIG. 16 is a cross-sectional view of another exemplary showerhead assembly in accordance with the present disclosure.

Turning to FIG. 16, another exemplary showerhead assembly 310 is illustrated. The showerhead assembly 310 is similar to the showerhead assembly 10 of FIGS. 1-5 with the exception of the profile of click pins 350 and the corresponding profile of annular recess 386. For the sake of brevity, only these differences will be discussed herein. It should be appreciated that the features of the showerhead assembly 310 described below can be used in connection with any other embodiment of the present disclosure.

As shown, the annular recess 386 has a compound profile as compared to the radiused annular recess 86 of the showerhead assembly 10 of FIGS. 1-5. That is, the annular recess 386 has a first angled surface 388, a bottom surface 390, and a second angled surface 392. The first angled surface 388 is of a relatively steeper angle as compared to the second angled surface 392.

Likewise, each click pin 350 has a compound profile corresponding to the compound profile of the annular recess 386 with a first angled surface 394, a second angled surface 396 and a connecting surface 398. As will be appreciated, the first angled surface 394 of each click pin 350 is configured to engage the first angled surface 388 of the annular recess 386, the second angled surface 392 of each click pin 350 is configured to engage the second angled surface 392 of the annular recess 386, and the connecting surface 398 is configured to engage the bottom surface 390 of the annular recess 386.

It has been found that the disclosed profiles of the annular recess 386 and click pins 350 provide an optimum balance between ease of coupling and coupling mechanism retention force. This is at least in part accomplished by the less steep second angled surface 392 allowing for a more gradual radially outward urging of each click pin 350 as the showerhead is seated on the receiver and, once seated on the receiver, the more steeply angled first angled surface of the lock pins 350. To this end we note that knob 376 has a leading angled surface 400 configured to correspond to the first angled surface 394 of each click pin 350 during coupling of the showerhead.

Once coupled, first angled surface 388 of the annular recess 386 and first angled surface 394 require a more abrupt radially outward urging of the click pins 350 in order to effect removal of the showerhead from the receiver, thereby increasing the coupling retention force.

It should be appreciated that aspects of the various embodiments can be interchanged as shown and described. Other embodiments can employ certain features of one embodiment in conjunction with certain features of another embodiment. Accordingly, the illustrated exemplary embodiments are but a few of many embodiments in accordance with the present disclosure.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A water dispensing assembly comprising:

a handheld dispenser;

a receiver mountable to an outlet pipe;

a coupling mechanism for releasably coupling the handheld dispenser with the receiver;

wherein the coupling mechanism includes a male component adapted to be received in a female component, the male component being associated with the receiver and the female component being associated with the handheld dispenser;

wherein the male component extends from a front surface of the receiver opposite an inlet of the receiver;

wherein the female component includes a recess in a surface of the handheld dispenser opposite a surface of the handheld dispenser having a water outlet;

wherein the female component further includes at least one pin supported for radial movement within the recess between a first radially inner position extending at least partially into the recess, and a second radially outer position;

wherein the male component includes a circumferential recess on a radially outer side thereof, the circumferential recess configured to receive the at least one pin when the male component is received in the female component thereby restricting separation of the handheld dispenser from the receiver; and wherein the at least one pin includes a compound profile having a first angled surface extending at a first non-perpendicular angle with respect to a longitudinal axis of the at least one pin and a second angled surface extending at a second non-perpendicular angle with respect to the longitudinal axis of the at least one pin, the first angle and second angle being different angles, the first and second angled surfaces converging radially inwardly towards the longitudinal axis of the at least one pin and meeting a connecting surface of the at least one pin; and wherein the circumferential recess includes a compound profile having at least two angled surfaces corresponding to the first angle and the second angle of the first angled surface and the second angled surface of the at least one pin.

2. The water dispensing assembly of claim 1, where the at least one pin is biased towards the first radially inner position.

3. The water dispensing assembly of claim 2, wherein the at least one pin includes a shoulder for limiting further radially inward movement of the pin beyond the first radially inner position, the shoulder adapted to contact a surface of the receiver to produce audible feedback when the at least one pin is received in the circumferential recess of the male component.

4. The water dispensing assembly of claim 3, wherein a rear surface of the handheld dispenser extends at a non-zero angle relative to a handle portion of the handheld dispenser.

5. The water dispensing assembly of claim 1, wherein the male component is tapered, and wherein the female component has a corresponding tapered shape to receive the male component.

6. The water dispensing assembly of claim 1, further comprising a retention flange on the handheld dispenser adapted to engage a lip of the receiver, the lip being spaced radially outwardly from the male component.

7. The water dispensing assembly of claim 6, wherein the retention flange is arcuate and spaced apart from the recess.

8. The water dispensing assembly of claim 7, further comprising a protrusion extending from the handheld dispenser at a location between the retention flange and the recess, the protrusion cooperating with a receiver recess for centering the handheld dispenser relative to the receiver when the retention flange is engaged with the lip.

9. The water dispensing assembly of claim 7, wherein the retention flange includes an axially extending wall and a radially inwardly extending wall, the radially inwardly extending wall adapted to restrict axial separation of the handheld dispenser from the receiver when engaged with the lip.

10. The water dispensing assembly of claim 1, wherein the receiver includes a flow passageway for transmitting water from an inlet to an outlet.

11. The water dispensing assembly of claim 1, wherein the male component terminates at a distal end face, and wherein the angled surface of the recess closer to the distal end face is steeper than the angled surface further away from the distal end face.

12. The water dispensing assembly of claim 11, wherein the first angled surface of the at least one pin is configured to engage the angled surface of the recess closer to the distal end face.

13. The water dispensing assembly of claim 12, wherein the male component further includes a leading angled surface configured to urge the at least one pin radially outwardly during coupling of the handheld dispenser to the receiver.

14. The water dispensing assembly of claim 1, wherein the handheld dispenser comprises a handheld showerhead.

* * * * *